US006156392A

United States Patent [19]

Duffy et al.

[11] Patent Number: 6,156,392

[45] Date of Patent: Dec. 5, 2000

[54] PROCESS FOR TRIBOELECTRIC APPLICATION OF A FLUOROPOLYMER COATING TO A THREADED FASTENER

[75] Inventors: Richard J. Duffy, Shelby Township; Eugene D. Sessa, Harrison Township, both of Mich.

[73] Assignee: Nylok Fastener Corporation, Macomb, Mich.

[21] Appl. No.: 09/352,431

[22] Filed: Jul. 13, 1999

[51] Int. Cl.[7] ..... B05D 1/06; B05D 7/22

[52] U.S. Cl. ..... 427/475; 427/476; 427/477; 427/481; 427/486

[58] Field of Search ..... 427/475, 476, 427/477, 481, 485, 486

[56] References Cited

U.S. PATENT DOCUMENTS

| | | |
|---|---|---|
| Re. 33,766 | 12/1991 | Duffy et al. . |
| 1,751,343 | 3/1930 | Mack . |
| 1,835,603 | 12/1931 | Kincaid, Jr. . |
| 2,761,997 | 9/1956 | Forest et al. . |
| 2,764,712 | 9/1956 | Juvinall . |
| 2,770,494 | 11/1956 | Nelson . |
| 2,806,444 | 9/1957 | Werner et al. . |
| 2,808,343 | 10/1957 | Simmons . |
| 2,893,894 | 7/1959 | Ransburg . |
| 2,903,190 | 9/1959 | LeDeit . |
| 2,961,581 | 11/1960 | Grave et al. . |
| 3,021,077 | 2/1962 | Gauthier . |
| 3,022,016 | 2/1962 | Shrewsbury . |
| 3,048,498 | 8/1962 | Juvinall et al. . |
| 3,069,387 | 12/1962 | Allen . |
| 3,082,956 | 3/1963 | Point . |
| 3,085,749 | 4/1963 | Schweitzer et al. . |
| 3,099,497 | 7/1963 | Albert . |

(List continued on next page.)

FOREIGN PATENT DOCUMENTS

| | | |
|---|---|---|
| 2733802 | 2/1979 | Germany . |
| 1192210 | 9/1980 | Japan . |
| 710852 | 6/1954 | United Kingdom . |

OTHER PUBLICATIONS

Reddy, Vishu, Powder Spray Technologies and Their Selection, Reprinted from Plating and Surface Finishing, Jun. 1989.

Knobbe, Alan J., *Powder Spray Guns*, pp. 192–195. No date.

Hughes, J.F., Electrostatic Particle Charging: Industrial and Health Care Applications, Research Studies Press, Ltd., 1997, pp. 1–27, 95–109 and 143–164.

Products Finishing Magazine, Jan. 1990, vol. 54, No. 4, 5 pages.

*Primary Examiner*—Fred J. Parker

*Attorney, Agent, or Firm*—Niro, Scavone, Haller & Niro

[57] ABSTRACT

The present invention is directed to a process for the application of fluoropolymer to a preselected area of a threaded fastener, and particularly to substantially all of the threads of the fastener. The fluoropolymer is supplied to a spray nozzle in powder form and is subjected to a triboelectrostatic charging process so that individual particles discharged from the spray nozzle are electrically charged. In the preferred form of the invention, the fluoropolymer powder is triboelectrically charged, entrained in an air stream discharged from the nozzle and directed onto the preselected area of the fastener. In this manner a generally uniform powder coating is deposited onto the preselected area of the fastener while the fastener is maintained at room temperature. Thereafter, the fastener is heated to a temperature above the melting point of the fluoropolymer to thereby coalesce the deposited powder into a continuous film coating which adheres, upon cooling, to the pre-selected area of the fastener. In accordance with a preferred embodiment, the fastener is heated in a manner which raises the temperature of only the preselected area of the fastener to the fluoropolymer melting point. This preferred heating technique minimizes the retention of fluoropolymer inadvertently deposited on areas of the fastener other than the preselected area, and allows this undesired fluoropolymer to be easily removed, even after heating.

9 Claims, 4 Drawing Sheets

U.S. PATENT DOCUMENTS 3,121,024 2/1964 Wampler et al. .
3,147,146 9/1964 Sedlacsik, Jr. .
3,178,114 4/1965 Point .
3,248,606 4/1966 Fraser .
3,335,965 8/1967 Riccio .
3,441,073 4/1969 Johnson .
3,494,243 2/1970 Kleinhenn .
3,579,684 5/1971 Duffy .
3,720,533 3/1973 Gallagher .
3,723,933 3/1973 Loepfe et al. .
3,787,222 1/1974 Duffy .
3,814,156 6/1974 Bachmann et al. .
3,894,509 7/1975 Duffy et al. .
3,896,760 7/1975 Duffy .
3,903,321 9/1975 Schaad .
3,975,787 8/1976 Newnom .
4,000,982 1/1977 Ueda .
4,035,859 7/1977 Newnom .
4,060,868 12/1977 Axvig et al. .
4,071,192 1/1978 Myers .
4,080,233 3/1978 McCloskey et al. .
4,100,882 7/1978 Duffy et al. .
4,109,027 8/1978 Crose .
4,114,505 9/1978 Loeser et al. .
4,114,564 9/1978 Probst .
4,120,993 10/1978 Duffy et al. .
4,154,871 5/1979 White et al. .
4,285,378 8/1981 Wallace .
4,366,190 12/1982 Rodden et al. .
4,380,039 4/1983 King .
4,626,365 12/1986 Mori .
4,656,051 4/1987 Wojcik .
4,689,241 8/1987 Richart et al. .
4,775,555 10/1988 Duffy .
4,779,558 10/1988 Gabel et al. .
4,815,414 3/1989 Duffy et al. .
4,835,819 6/1989 Duffy et al. .
4,837,090 6/1989 Hyner et al. .
4,842,890 6/1989 Sessa et al. .
4,869,921 9/1989 Gabel et al. .
4,986,210 1/1991 Hollstein et al. .
5,078,083 1/1992 DiMaio et al. .
5,090,355 2/1992 DiMaio et al. .
5,259,236 11/1993 English .
5,306,346 4/1994 DiMaio et al. .
5,362,327 11/1994 Sessa et al. .
5,476,689 12/1995 Stone et al. .
5,506,491 4/1996 Ford .
5,518,546 5/1996 Williams et al. .
5,534,064 7/1996 Tsutsui et al. .
5,552,191 9/1996 Horinka et al. .
5,571,323 11/1996 Duffy et al. .
5,607,720 3/1997 Wallace et al. .
5,792,512 8/1998 Duffy et al. .
5,820,941 10/1998 Felton et al. .

PROCESS FOR TRIBOELECTRIC APPLICATION OF A FLUOROPOLYMER COATING TO A THREADED FASTENER

BACKGROUND OF THE INVENTION

The present invention relates to fluoropolymer coated fasteners, and, more particularly, to a new process for effectively and efficiently coating preselected portions of threaded fasteners with a fluoropolymer.

It has been recognized for some time that threaded fasteners may be protected from thread contaminants by coating the threads with fluoropolymer resin. Typical contaminants that may interfere with proper threaded coupling of the fasteners include paint, anti-corrosion primers, weld spatter and solder. Coating the fastener threads with a fluoropolymer before exposure to these contaminants, reduces or prevents the contaminants from adhering to the fastener. In the use of such fluoropolymer coatings, however, it is important, and often critical, that the fluoropolymer coating be applied only to selected portions of the fastener. Indiscriminate application of the coating over all areas of the fastener is to be avoided. Examples of prior art teachings in this field are found in U.S. Pat. Nos. RE33,766 and 5,221,170. The disclosures of these patents are incorporated herein by reference.

Although the processes and coated fasteners as disclosed in the above identified patents have achieved substantial commercial success, they nonetheless suffer from certain disadvantages. For example, in the practice of this prior art the fasteners are heated prior to application of the fluoropolymer powder. As a result, the fasteners are necessarily heated to a temperature substantially above the fluoropolymer melting point to accommodate some cooling of the fastener during transit from the heating station to the powder spray station. This elevated temperature, in the range of about 750° to 900° F., can damage certain fastener materials or platings, thus, limiting the applicability of the prior art technology.

Another disadvantage associated with the prior art is that relatively large amounts of fluoropolymer powder are required to achieve a generally uniform and continuous coating, thereby raising the cost of the process.

Another disadvantage with the prior art is that, traditionally, fluoropolymer coatings are baked and sintered for extended periods of time, increasing processing time.

Initial experiments were conducted some time ago in an attempt to electrostatically deposit fluoropolymer powders using conventional corona charging techniques. However, the resulting fluoropolymer powder coating was indiscriminately applied onto a wide area of the fastener, requiring some form of masking to limit the coating to only the preselected areas where the coating was desired. Additionally, when attempting to coat internally threaded fasteners, Faraday cage effects come into play, which further limits the integrity of the resulting coating. The possibility of electrostatically depositing the powder by corona charging techniques was therefore rejected since masking would prove too difficult and costly in high volume production.

There is, accordingly, a need for a new fluoropolymer coating process that employs lower temperatures, less fluoropolymer resin and is less costly; while maintaining the benefits and advantages of the known powdered fluoropolymer application technology.

SUMMARY OF THE INVENTION

The present invention is directed to a process for the application of fluoropolymer to a preselected area of a threaded fastener, and particularly to substantially all of the threads of the fastener.

The fluoropolymer is supplied to a spray nozzle in powder form and is subjected to a triboelectrostatic charging process so that individual particles discharged from the spray nozzle are electrically charged. In the preferred form of the invention, the fluoropolymer powder is triboelectrically charged, entrained in an air stream discharged from the nozzle and directed onto the preselected area of the fastener. In this manner a generally uniform powder coating is deposited onto the preselected area of the fastener while the fastener is maintained at room temperature. Thereafter, the fastener is heated to a temperature above the melting point of the fluoropolymer to thereby coalesce the deposited powder into a continuous film coating which adheres, upon cooling, to the pre-selected area of the fastener.

The process of the present invention may be used with either internally or externally threaded articles, such as internally or externally threaded fasteners. In accordance with one preferred embodiment, an externally threaded fastener is heated in a manner which raises the temperature of only a preselected area of the fastener to the fluoropolymer melting point. This preferred heating technique minimizes the retention of fluoropolymer inadvertently deposited on areas of the fastener other than the preselected area, and allows this undesired fluoropolymer to be easily removed, even after heating.

Using the present invention, the coating of internally threaded fasteners may be confined to the threaded area only and, therefore, the entire fastener may be heated to coalesce the deposited powder.

With the present invention, heating times required for fluoropolymer adherence may be substantially decreased.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings, in which:

DESCRIPTION OF THE PREFERRED EMBODIMENTS

The process of the present invention is illustrated in FIGS. 1, 2, 6 and 7 with respect to the selective fluoropolymer coating of externally threaded fasteners, such as a conventional weld stud. The invention is not limited, however, to the illustrated fastener; but, rather, finds application with both externally and internally threaded fasteners of all kinds and configurations. Its advantages arise from the ability to easily and expeditiously coat only preselected areas of the fastener, at high production volumes, without the need to mask the remaining areas where the coating is neither needed nor desired.

Figure 1:
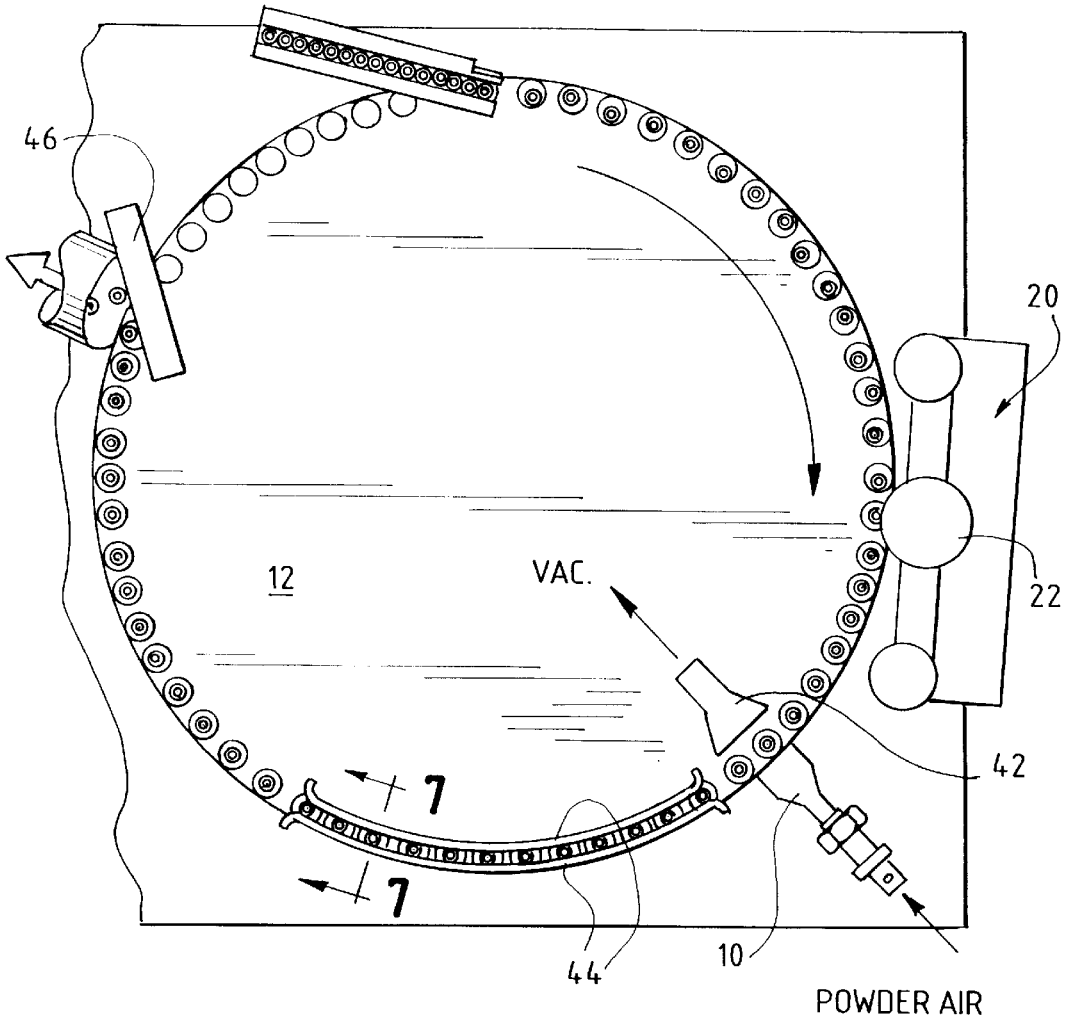
FIG. 1 is a plan view, illustrating a carousel assembly suitable for implementing the process of the present invention with externally threaded fasteners.
Figure 2:
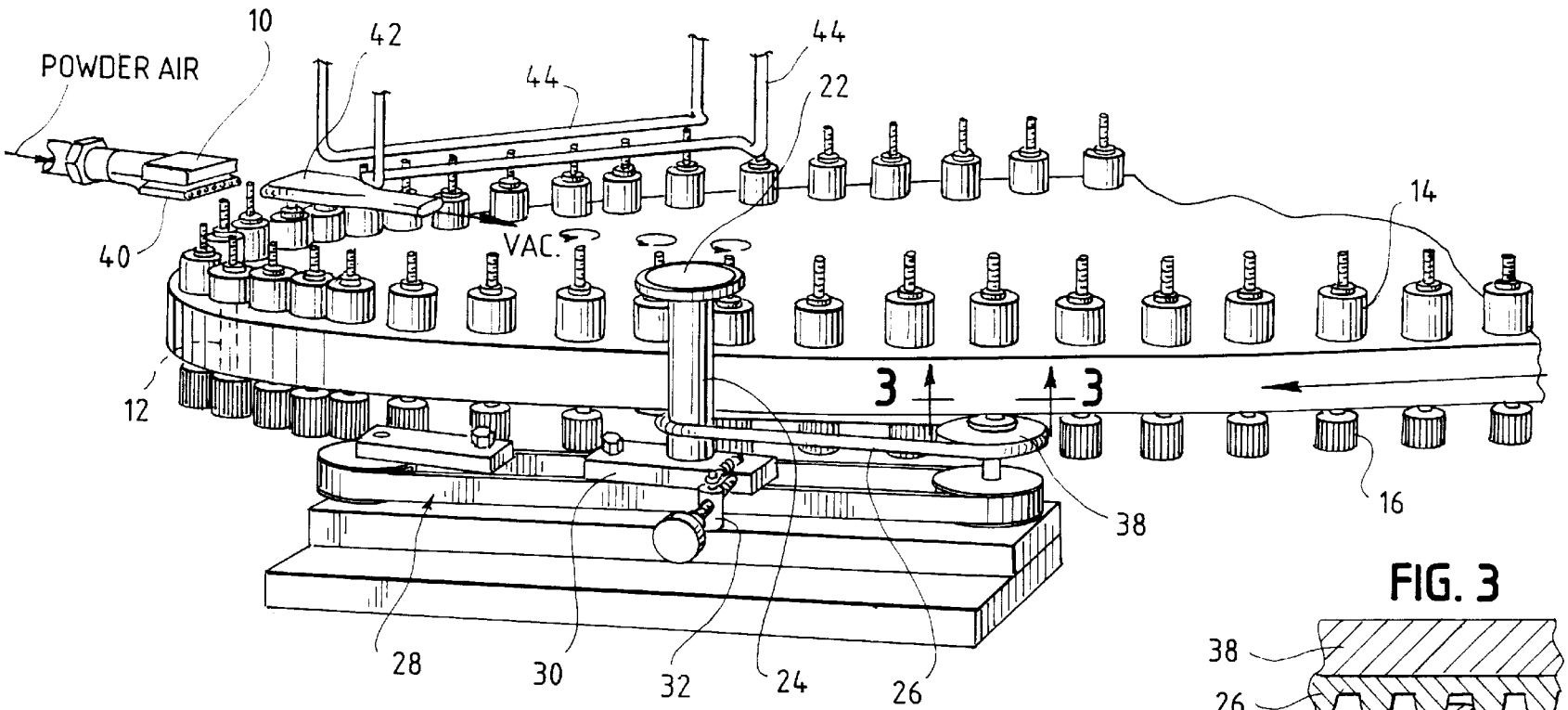
FIG. 2 is a partial perspective view of the assembly illustrated in FIG. 1.
Figure 3:
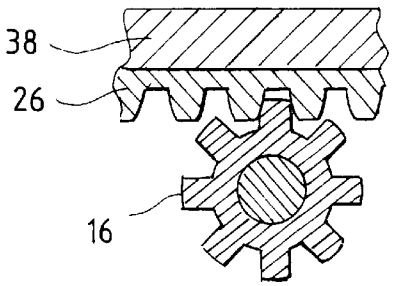
FIG. 3 is a partial cross-sectional view of the fastener rotation mechanism.
Figure 4:
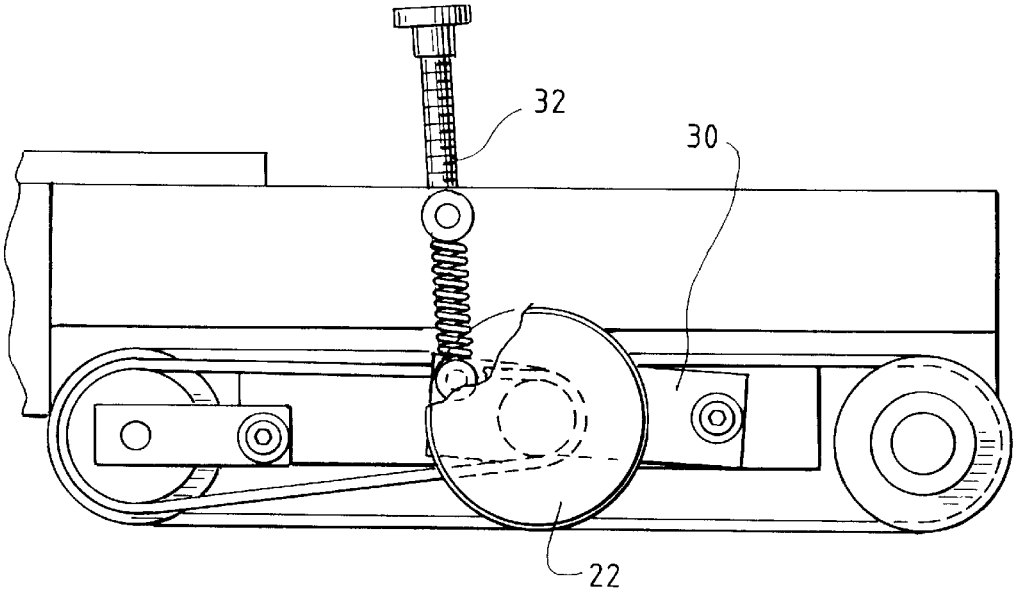
FIGS. 4 and 5 are top and side views, respectively, of an appropriate fastener centering mechanism used in the carousel assembly illustrated in FIG. 1.
Figure 5:
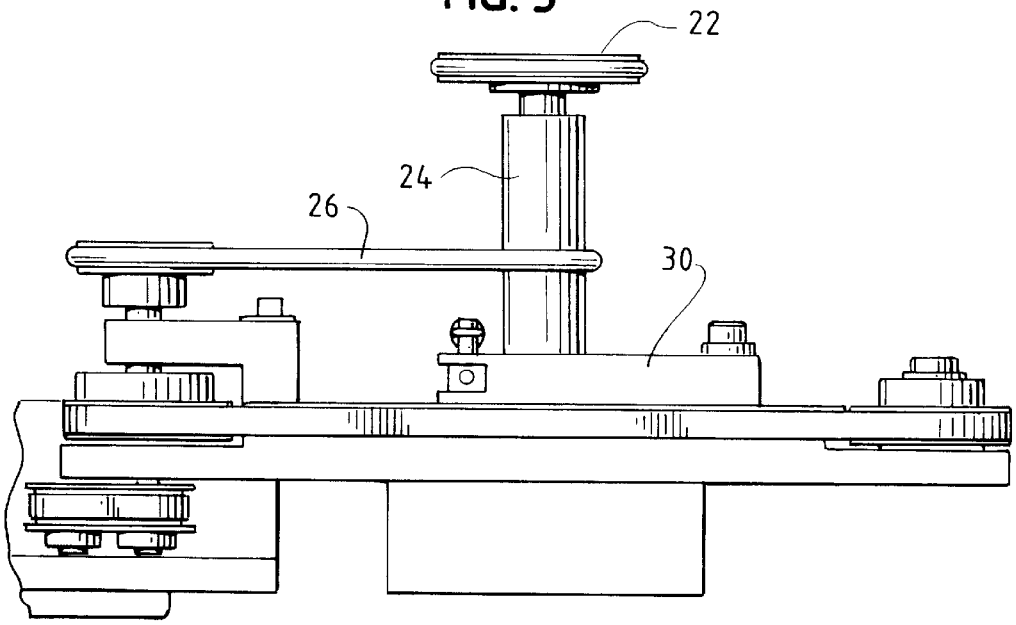
Figure 6:
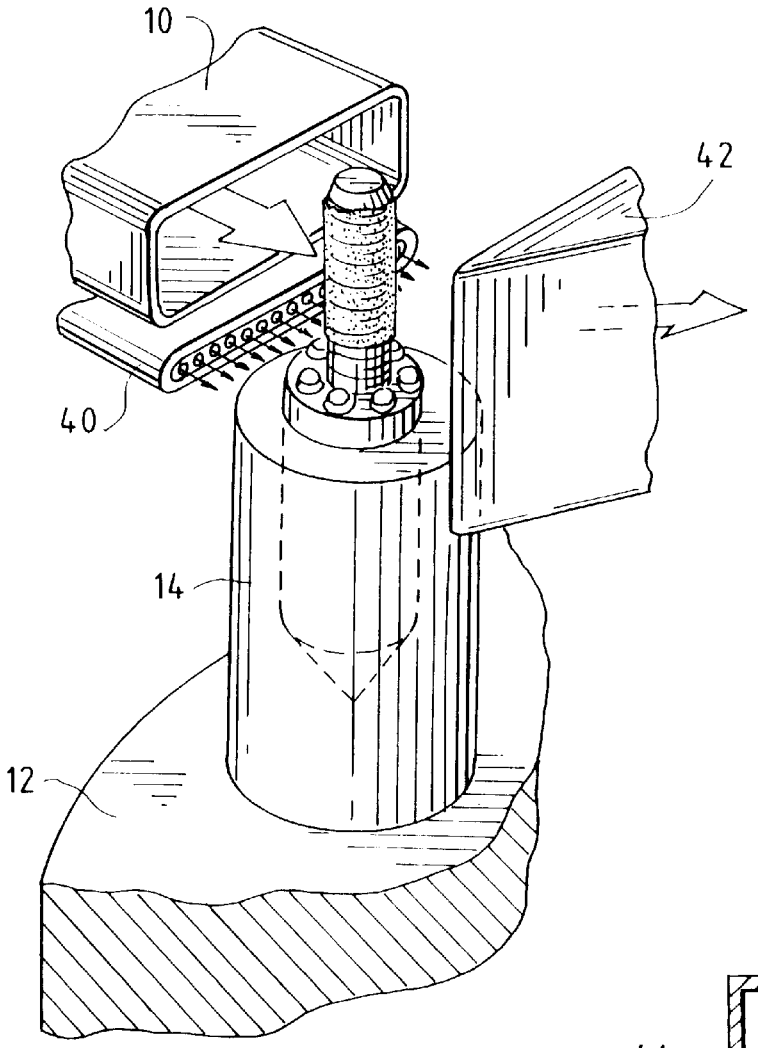
FIG. 6 is a perspective view illustrating details of the powder stream nozzle, fastener and fastener support, and vacuum nozzle used in the assembly of FIG. 1.

In FIG. 1, the fluoropolymer powder is provided to the supply port of a conventional powder spray nozzle 10. Typical spray nozzles of this sort employ high pressure air at about 40 to 80 psi to aspirate the supply powder and to generate powder stream entrained in the discharging air.

Preferably, the fluoropolymer powder is a perfluoro alkoxy resin, manufactured by DuPont under the trade designation PFA powder-white, product code 532-5100. This powder has a particle size of about 20±3 microns.

A variety of powder spray nozzles and associated supply apparatus may be used in the practice of the present invention. Suitable examples are disclosed in U.S. Pat. Nos. 3,579,684; 4,815,414; 4,835,819; 5,090,355; 5,571,323; and 5,792,512 whose disclosures are incorporated herein by reference.

The fasteners may be positioned within, or conveyed to intersect, the powder stream using well known apparatus. Again, suitable examples are illustrated in U.S. Pat. Nos. 3,894,509; 4,120,993; 4,775,555; 4,842,890; and 5,078,083. These patents' disclosures are also incorporated herein by reference. The illustrated apparatus comprises a horizontally rotating carousel 12 having fastener carrying posts 14 disposed about its circumference. The carrying posts 14 are preferably constructed from a material having a relatively high heat transfer coefficient, such as aluminum, brass, steel or copper. In addition, the posts each preferably house a centrally disposed magnet 15 to assist in maintaining each fastener in proper position.

Each fastener carrying post 14 is rotationally mounted to the carousel 12 and may be driven by a gear or sprocket 16 extending from the lower end of the posts. The gear will rotate when it traverses and engages an appropriately positioned, variable speed, motor-driven timing belt (not shown), thereby rotating the post and fastener when the fastener is in the powder stream. Examples of other suitable rotational fastener carriers are disclosed in U.S. Pat. Nos. 4,842,890; 5,078,083 and 5,090,355 whose disclosures are incorporated herein by reference.

A fastener centering station 20 may also be employed. This device centers the fasteners on carrying post 14 to provide wobble-free rotation when the fastener is in the powder stream. One preferred form of this centering station is illustrated in FIGS. 2–5.

It utilizes a fastener engaging wheel 22 which is rotationally driven via drive post 24, drive belt 26, connected wheel 38, and a drive assembly 28 including a drive belt 18. Belt 18 engages sprockets 16 to rotate the fasteners. Belt 26 may be driven by the same or a second, suitably positioned, variable speed motor (not shown). The radial position of wheel 22 relative to carousel 12 is made adjustable by mounting the drive post 24 on a pivotally mounted support bar 30. The bar 30, in turn, can be positioned using threaded rod 32. Rotation of rod 32 will pivot support bar 30, thereby adjusting the radial position of wheel 22.

In accordance with the preferred embodiment of the invention, the powder stream may be configured or shaped, at least in part, by the geometry of the nozzle discharge port. Thus, a vertically narrow stream may be formed with a nozzle having a small vertical dimension and, conversely, a vertically broad stream will result from use of a nozzle having a large vertical dimension. The horizontal extent of the stream may be similarly controlled. In addition, an air knife 40 (see FIG. 6) can be positioned either below or above (or both below and above) the nozzle 10. As illustrated, the air knife 40 positioned below the nozzle discharge port will delimit the lower extent of the powder stream, tending to reduce the deposition of powder onto the fastener's lower area or the fastener carrying posts 14.

It is also desirable to employ a vacuum collection system to capture and re-circulate powder from the powder stream that is not deposited on the fasteners. Typically, the vacuum nozzle 42 will be located, as illustrated, in juxtaposition to the spray nozzle 10 and will be sized somewhat larger than the cross-sectional area of the powder stream.

In accordance with an important aspect of the invention, it is necessary to condition the fluoropolymer powder so that it will be retained on only a preselected area of the fastener, usually substantially all of the threaded portion of the fastener. The powder must be evenly deposited onto the preselected area and retained until heated to its melting point and thereby coalesced into an adherent continuous coating. Moreover, it must be so retained while the fastener is transported, via the carousel 12 or other conveyor, to the heating station. Preferably, the powder is triboelectrically charged by its rapid passage through appropriate tubing from the powder supply reservoir and by its rapid passage through the spray nozzle itself. In this way, a moderate electrostatic charge, in the range of about $1\times10^{-7}$ to about $3\times10^{-3}$ coulombs per kilogram, will be generated on the powder stream.

Although nylon, vinyl or polyester tubing is preferred, other materials, even electrically conductive tubing such as metal has also found to perform satisfactorily. An electrical charge, or Mass Charge Density, on the powder in the range of about $1\times10^{-3}$ to $3\times10^{-3}$ coulombs per kilogram has been found to work well, and this charge may be generated using a conventional copper spray nozzle with air velocity through the nozzle in the range of about 300 to 350 meters per second and powder flow rates of about 1.5 to $3.0\times10^{-4}$ kilograms per second.

It has been found that the coverage of a triboelectric charged particle coating is defined mainly by the direction of the entraining air volume and not by corona field effects. In other words, the triboelectric charge assists in retaining the fluoropolymer on the areas of the fastener that directly intersect the powder stream while the shape of the powder stream and the use of an appropriately positioned air knife minimize the deposition of powder on other areas of the fastener where a fluoropolymer adherent coating is undesirable. Thus, by properly configuring the powder stream and positioning the fasteners relative to the stream, a suitable fluoropolymer powder coating may be deposited substantially on only the desired areas of the fasteners. As one example, the coating of internally threaded fasteners may be confined to the threaded area only and, therefore, the entire fastener may be heated to coalesce the deposited powder.

It has also been discovered that the use of triboelectrically charged powder results in a highly uniform and complete powder coating with a minimum volume of powder. Indeed, very uniform and pinhole free coatings are achieved, after heating, even with coatings that are less than ½ mil (0.0005 in) in thickness.

After the fasteners have been coated with fluoropolymer powder, they are transported via the carousel 12 into a heating station. Again, many different heating apparatus may be employed, but an induction heating coil 44 has been found most satisfactory. Such coils are described in U.S. Pat. Nos. 5,306,346 and 5,632,327; whose disclosures are incorporated herein by reference. Induction heating raises the temperature of the fastener at the fastener's surface. Because the fluoropolymer is in direct contact with this surface, it is heated via conductive heat transfer. As a result, the fastener need only be heated slightly above the fluoropolymer melting point (about 580° F.), or typically in the range of about 600° to 650° F. This is substantially below the temperatures required for preheated fastener fluoropolymer coating which typically requires heating of the fasteners to about 750° to 900° F. Consequently, the process of the present invention finds particularly advantageous application when coating plated fasteners, such as zinc plated fasteners which will often degrade when heated above about 700° F.

According to a preferred aspect of the present invention, the fluropolymer-coated fasteners are heated for a relatively short period of time, sufficient to melt the fluoropolymer. Using induction heating coils, the fluoropolymer powder, initially at room temperature, is quickly heated to temperatures which may be in the range of 600° F.–650° F. Thus, with the present invention, heating times required for application of the fluoropolymer powder may be substantially lessened, such as to 30 minutes or less. Preferably, heating times are only 5–10 minutes or less and, still more preferably, are less than about 1 minute. In the particularly preferred embodiment, melting of the fluoropolymer coating on the desired portions of the fastener is accomplished in less than about 10 seconds, and even as fast as about 1–2seconds or less.

In one preferred embodiment using the apparatus shown in the drawings, M10 weld studs were coated. The number of fasteners coated and the time taken to achieve melting of the fluoropolymer powder for each fastener is shown below:

| Number of fasteners coated/minute | Seconds to achieve melting |
|---|---|
| 60 | 9.6 |
| 120 | 4.8 |
| 180 | 3.2 |
| 240 | 2.4 |

Figure 7:
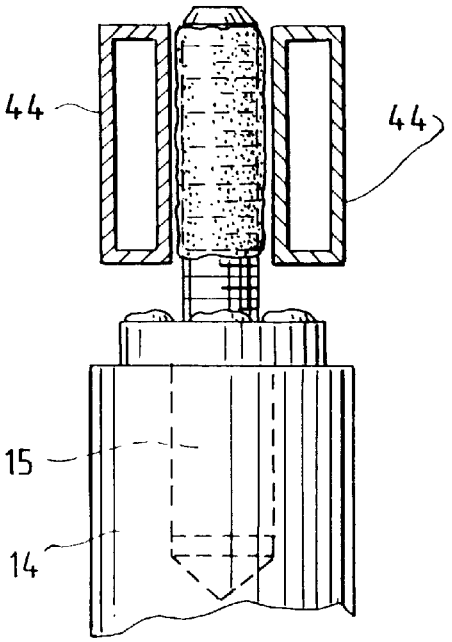
FIG. 7 is a partial cross-sectional view illustrating the positional relationship between the fastener and heating coils as preferably used in the assembly of FIG. 1.

In accordance with the present invention, the induction heating coils 44 can be positioned to selectively heat the fasteners. As illustrated in FIG. 7, the weld studs are supported on the carrying posts 14 so that their threaded shank portions pass directly between the coils 44 while their heads are positioned below the coils. In this way, the threaded portions will be heated to the desired temperature while the non-threaded portions will remain below the fluoropolymer melting point. This selective heating is facilitated by using a highly heat conductive carrying post and magnet which act as a heat sink to minimize the temperature of the fastener adjacent the post.

Selective heating has several advantages. First, it insures that the adherent fluoropolymer coating is achieved only in the areas where fluoropolymer melting point temperatures are reached—in the threaded portion. Thus, any fluoropolymer powder deposited in other areas will be easily removed when the fastener is submerged in the anti-corrosion cooling bath. Moreover, lower energy consumption and higher production rates may also be achieved. Finally, selective heating allows the use of less discriminating powder application techniques, such as corona charging electrostatic deposition of the fluoropolymer, where powder is initially deposited over substantially greater areas of the fastener than are desired for the finally coated part.

It should be noted here, that references to a powder "deposited" on and "retained" on the fastener are intended to mean only that the powder will remain in place during transport to the heating station. In this condition, it can be easily removed from the fastener via high velocity gas streams, mechanical brushing or a liquid wash. On the other hand, references to an "adherent" coating are intended to mean that the fluoropolymer has coalesced into a substantially continuous film that adheres to the fastener's surface even when exposed to high velocity air or liquid streams or moderate mechanical abrasion. Most preferably, however, even the "adherent" fluoropolymer coating will be dislodged from the threaded portions of the fastener when engaged by a mating fastener and subjected to appropriate clamping loads.

After the fasteners pass through the heating station, they are removed from the carrying posts by a suitable cam 46 and/or air streams and either air cooled or immersed in a cooling bath, typically an aqueous based anticorrosion bath or other liquid treatment. The fasteners may be air cooled for about the same time as they are heated, prior to immersion in the cooling bath.

The resulting coated fastener has a fluoropolymer film adherent to its threaded portion. The film is generally uniform in thickness both at the crests and roots of the threads and is substantially pinhole free. Moreover, it is a substantially pure fluoropolymer coating having no binders, fillers or other incorporated compounds. In accordance with the present invention, the film may contain over 98% fluoropolymer, the remainder being a coloring pigment such as titanium dioxide. If desired, however, other compounds can be added to enhance the coating's mechanical and/or chemical properties.

The process of the present invention permits the selective coating of relatively small threaded fasteners at high production volumes without the need for preapplied masks on portions of the fastener where no coating is desired.

Of course, it should be understood that various changes and modifications to the preferred embodiments described herein will be apparent to those skilled in the art. Such changes and modifications can be made without diminishing its attendant advantages. It is therefore intended that such changes and modifications be covered by the following claims:

We claim:

1. A process for coating a selected portion of a threaded fastener with a fluoropolymer, comprising the steps of:

supplying the fluoropolymer in powder form to a spray nozzle;

supplying high pressure gas to the spray nozzle;

discharging a stream of fluoropolymer powder entrained in the gas from the nozzle;

subjecting the fluoropolymer powder to a triboelectric charging process so that particles of fluoropolymer in the powder stream are triboelectrically charged;

positioning the fastener within the powder stream to deposit a coating of the fluoropolymer powder onto at least a substantial portion of the threads of the fastener, whereby the triboelectric charge assists in retaining the fluoropolymer powder on the fastener; and heating the coated fastener to a temperature above the melting temperature of the fluoropolymer and thereafter cooling the coated fastener to coalesce the powder into a substantially continuous adherent fluoropolymer coating on the fastener.

2. The coating process of claim 1, wherein the fastener is an externally threaded fastener, and further comprising the step of removing fluoropolymer powder deposited on portions of the fastener other than the selected portion during or after cooling.

3. The coating process of claim 1, wherein the fastener is an externally threaded fastener and during the heating step portions of the fastener other than the fluoropolymer coated portion do not reach a temperature above the melting temperature of the fluoropolymer.

4. The coating process of claim 1, wherein the threaded fastener includes a zinc plating and wherein the zinc plating is substantially unaffected by the heating step.

5. The coating process of claim 1, wherein the fluoropolymer powder is charged to between about $1\times10^{-7}$ to about $3\times10^{-3}$ coulombs per kilogram.

6. A The process of claim 1, wherein heating of the fastener is accomplished using induction coils.

7. The process of claim 1, wherein the heating step is accomplished in about 1 minute or less.

8. The process of claim 1, wherein the heating step is accomplished in about 10 seconds or less.

9. A process for coating a selected portion of an internally threaded fastener with a fluoropolymer, comprising the steps of:

supplying the fluoropolymer in powder form to a spray nozzle;

supplying high pressure gas to the spray nozzle;

discharging a stream of fluoropolymer powder entrained in the gas from the nozzle;

subjecting the fluoropolymer powder to a triboelectric charging process so that particles of fluoropolymer in the powder stream are triboelectrically charged;

positioning the fastener within the gas entrained powder stream to deposit a coating of the fluoropolymer powder onto at least a substantial portion of the threads of the fastener, whereby the triboelectric charge assists in retaining the fluoropolymer powder on the fastener; and heating the coated fastener to a temperature above the melting temperature of the fluoropolymer and thereafter cooling the coated fastener to coalesce the powder into a substantially continuous adherent fluoropolymer coating on the fastener.

* * * * *